US005404611A

United States Patent [19]

Raney

[11] Patent Number: 5,404,611

[45] Date of Patent: Apr. 11, 1995

[54] PAINT ROLLER CONTAINER AND LID

[76] Inventor: Keith E. Raney, Box 162, 252 Alpine St., LaBarge, Wyo. 83123

[21] Appl. No.: 69,750

[22] Filed: Jun. 1, 1993

[51] Int. Cl.[6] ..... B44D 3/12

[52] U.S. Cl. ..... 15/257.06; 15/261; 220/212; 220/695; 220/697

[58] Field of Search ..... 15/257.06, 261; 220/212, 695, 697, 698

[56] References Cited

U.S. PATENT DOCUMENTS

| | | | |
|---|---|---|---|
| 2,204,190 | 6/1940 | Siegel | 15/257.06 |
| 2,705,334 | 4/1955 | Farrow | 15/257.06 |
| 2,723,410 | 11/1955 | Sprung | 15/257.06 |
| 2,827,648 | 3/1958 | Geisz | 220/695 |
| 2,911,663 | 11/1959 | Geary | 15/257.06 |
| 3,091,793 | 6/1963 | Bentley, Jr. | 15/257.06 |
| 3,576,045 | 4/1971 | Stafford | 15/257.06 |
| 3,837,034 | 9/1974 | Leffert | 15/257.06 |
| 4,233,705 | 11/1980 | Lepage | 15/257.06 |
| 4,424,949 | 1/1984 | Kimmett | 15/257.06 |
| 5,085,317 | 2/1992 | Jensen | 15/257.06 |

FOREIGN PATENT DOCUMENTS

| | | | |
|---|---|---|---|
| 1117398 | 5/1956 | France | 15/257.06 |
| 45527 | 2/1966 | Germany | 15/257.06 |
| 112401 | 2/1968 | Norway | 15/257.06 |

*Primary Examiner*—David A. Scherbel
*Assistant Examiner*—Randall E. Chin

[57] ABSTRACT

A container includes a lid member arranged for reception within spaced parallel U-shaped brackets mounted on opposed walls of the container to orient the brackets and the lid in a predetermined angular position relative to contents within the container. The lid structure includes plural rows of parallel ribs for accommodating a paint roller to express paint therefrom.

8 Claims, 5 Drawing Sheets

PAINT ROLLER CONTAINER AND LID

BACKGROUND OF THE INVENTION

1. Field of the Invention

The field of invention relates to paint container and lid structure, and more particularly pertains to a new and improved paint roller container and lid wherein the same is arranged for the removal and saving of paint relative to roller structure.

2. Description of the Prior Art

Paint containers of various types are utilized throughout the prior art, wherein U.S. Pat. No. 4,722,442 to Smith employs a drip shield for utilization with paint containers to receive a paint container therewithin to prevent spillage from paint containers extending to a surrounding surface.

U.S. Pat. No. 4,949,884 sets forth an example of a paint container lid of a one-piece molded construction, including a pour spout.

U.S. Pat. No. 4,736,488 to Nielsen sets forth a paint drip pan to receive a painter's wrist to support the pan permitting positioning of paint brushes and the like.

The instant invention attempts to overcome deficiencies of the prior art by providing a container having a lid portion arranged for mounting within the container, wherein a bottom surface of the paint lid includes ribs for receiving and directing paint into the container relative to a paint roller and in this respect, the present invention substantially fulfills this need.

SUMMARY OF THE INVENTION

In view of the foregoing disadvantages inherent in the known types of paint container apparatus now present in the prior art, the present invention provides a paint roller container and lid wherein the same employs a lid member arranged for projection within a container for directing paint from a roller into the underlying container. As such, the general purpose of the present invention, which will be described subsequently in greater detail, is to provide a new and improved paint roller container and lid which has all the advantages of the prior art paint container apparatus and none of the disadvantages.

To attain this, the present invention provides a container including a lid member arranged for reception within spaced parallel U-shaped brackets mounted on opposed wails of the container to orient the brackets and the lid in a predetermined angular position relative to contents within the container. The lid structure includes plural rows of parallel ribs for accommodating a paint roller to express paint therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint roller container and lid which has all the advantages of the prior art paint container apparatus and none of the disadvantages.

It is another object of the present invention to provide a new and improved paint roller container and lid which may be easily and efficiently manufactured and marketed.

It is a further object of the present invention to provide a new and improved paint roller container and lid which is of a durable and reliable construction.

An even further object of the present invention is to provide a new and improved paint roller container and lid which is susceptible of a low cost of manufacture with regard to both materials and labor, and which accordingly is then susceptible of low prices of sale to the consuming public, thereby making such paint roller containers and lids economically available to the buying public.

Still yet another object of the present invention is to provide a new and improved paint roller container and lid which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
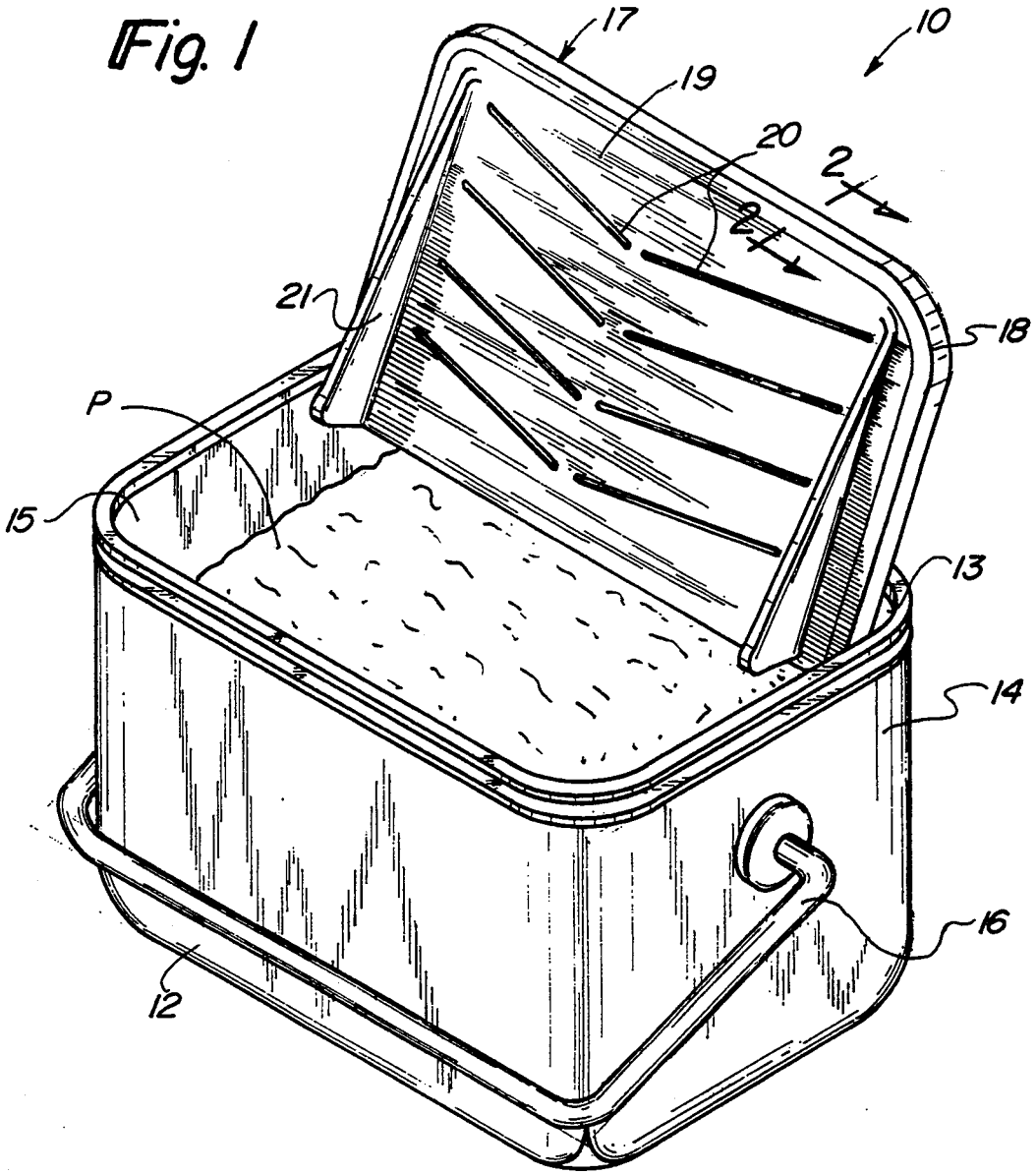
FIG. 1 is an isometric illustration of the invention.
Figure 2:
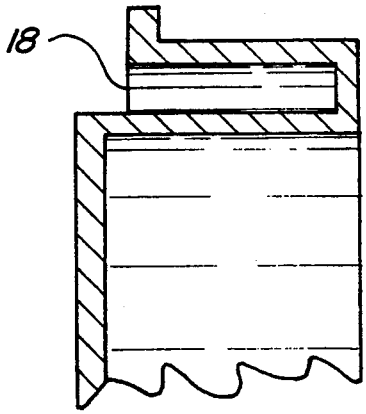
FIG. 2 is an orthographic view, taken along the lines 2—2 of FIG. 1 in the direction indicated by the arrows.
Figure 3:
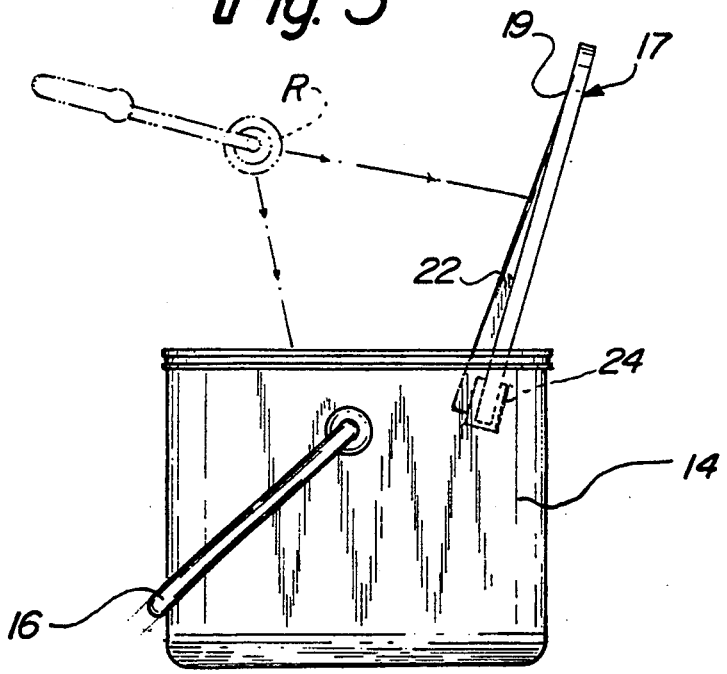
FIG. 3 is an orthographic end view of the invention.
Figure 4:
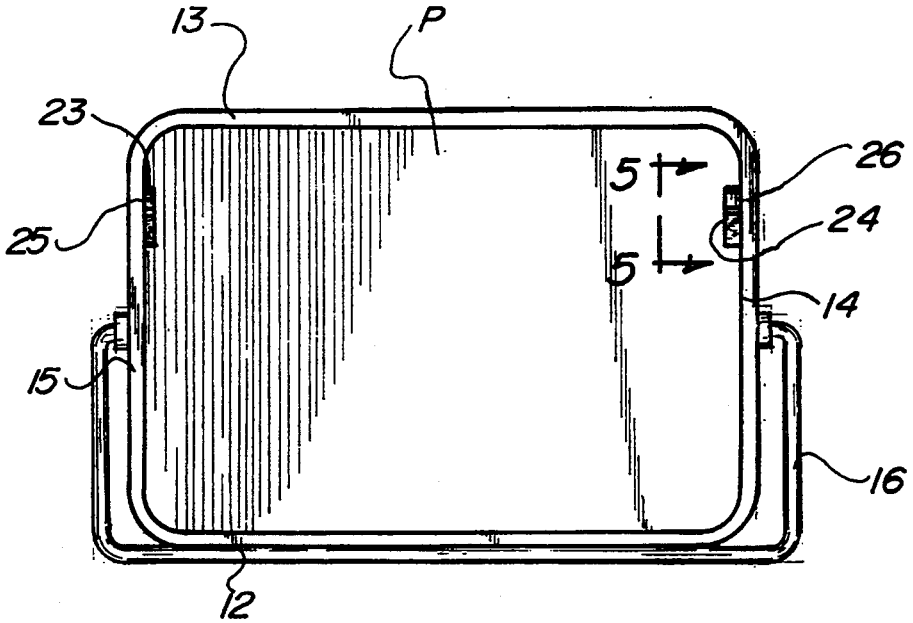
FIG. 4 is an orthographic top view of the invention with the lid removed therefrom.

With reference now to the drawings, and in particular to FIGS. 1 to 10 thereof, a new and improved paint roller container and lid embodying the principles and concepts of the present invention and generally designated by the reference numeral 10 will be described.

More specifically, the paint roller container and lid 10 of the instant invention essentially comprises a container 11 having a first side wall 12 spaced from a second side wall 13, a first end wall 14 spaced from a second end wall 15 guiding a predetermined quantity of paint "P" therewithin. A handle 16 is pivotally mounted to the first and second end walls 14 and 15. A lid member 17 is provided arranged for reception between the first and second end walls 14 and 15. The lid member includes a lid perimeter channel 18, whereupon application of the lid, the uppermost end portion of the container is received within the channel 18. The lid includes a lid bottom wall 19 having plural rows of parallel ribs 20, wherein each row of ribs are canted towards the container 11 when the lid is mounted within the container, as illustrated in FIG. 1. First and second wing plates 21 and 22 are mounted to the bottom wall in an orthogonal relationship, wherein the first and second wing plates 21 and 22 are parallel relative to one another on opposed sides of the ribs 20 to channel paint directed onto the ribs into the container. Respective first and second U-shaped brackets 23 and 24 are mounted interiorly of the container to the respective first and second end walls 14 and 15. Each of the first and second U-shaped brackets 23 and 24 define respective first and second slots 25 and 26 receiving the lid 17 therewithin.

Figure 5:
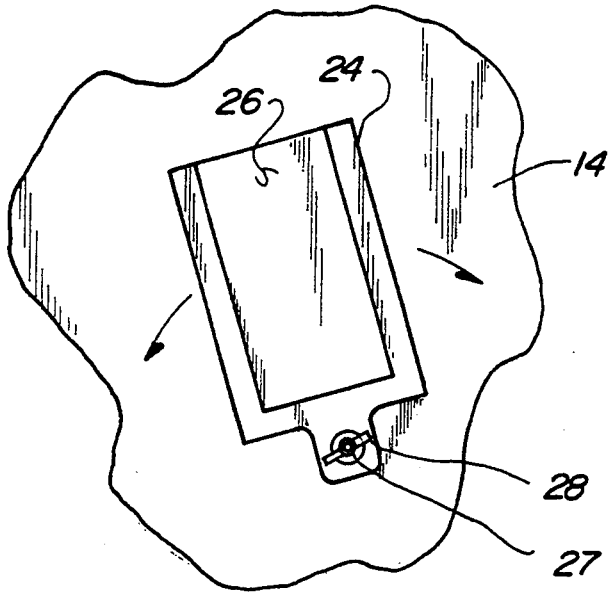
FIG. 5 is an orthographic view, taken along the lines 5—5 of FIG. 4 in the direction indicated by the arrows.

FIG. 5 indicates each bracket having a bracket axle 27 pivotally mounting each bracket, with a fastener 28 securable to the axle to fixedly secure the brackets in an angular orientation relative to an uppermost perimeter of the container to permit selective angulation of the lid relative to the container in use.

Figure 6:
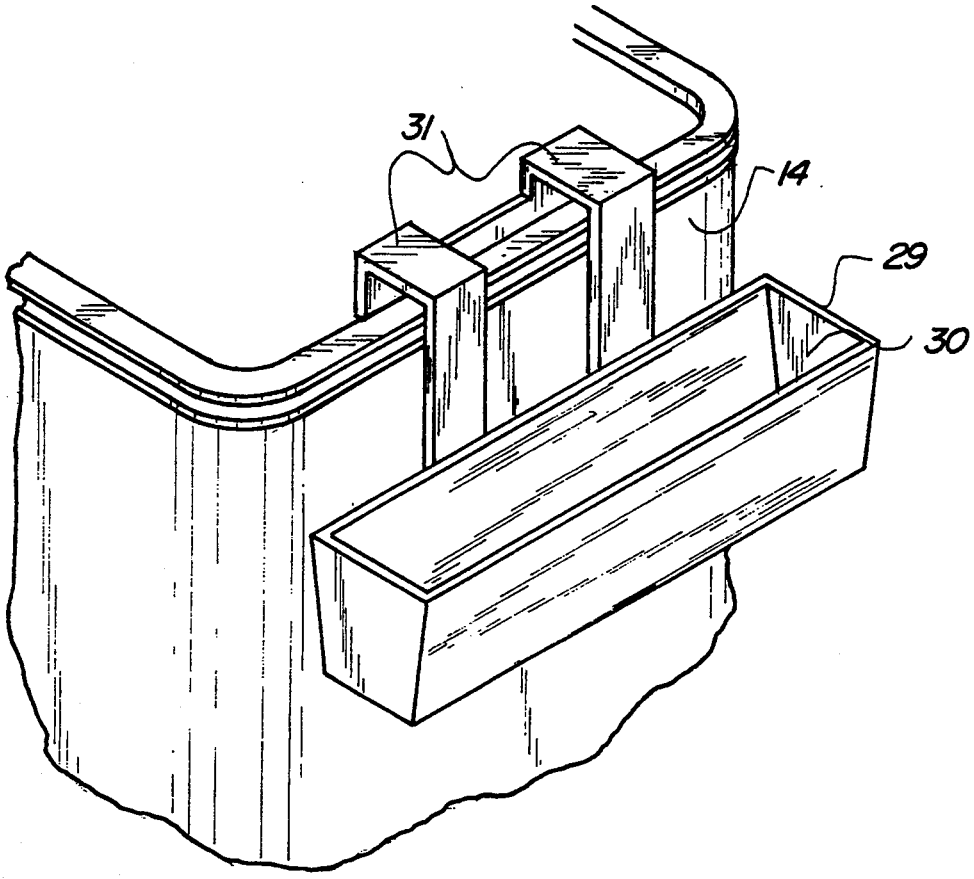
FIG. 6 is an isometric illustration of the invention employing a side wall mounted trough structure.

FIG. 6 indicates the use of a trough member 29, having an elongate trough cavity 30 for positioning a roller therewithin. The trough member 29 includes a plurality of trough U-shaped mounting legs 31 permitting positioning of the trough onto the container first end wall 14, as illustrated.

Figure 7:
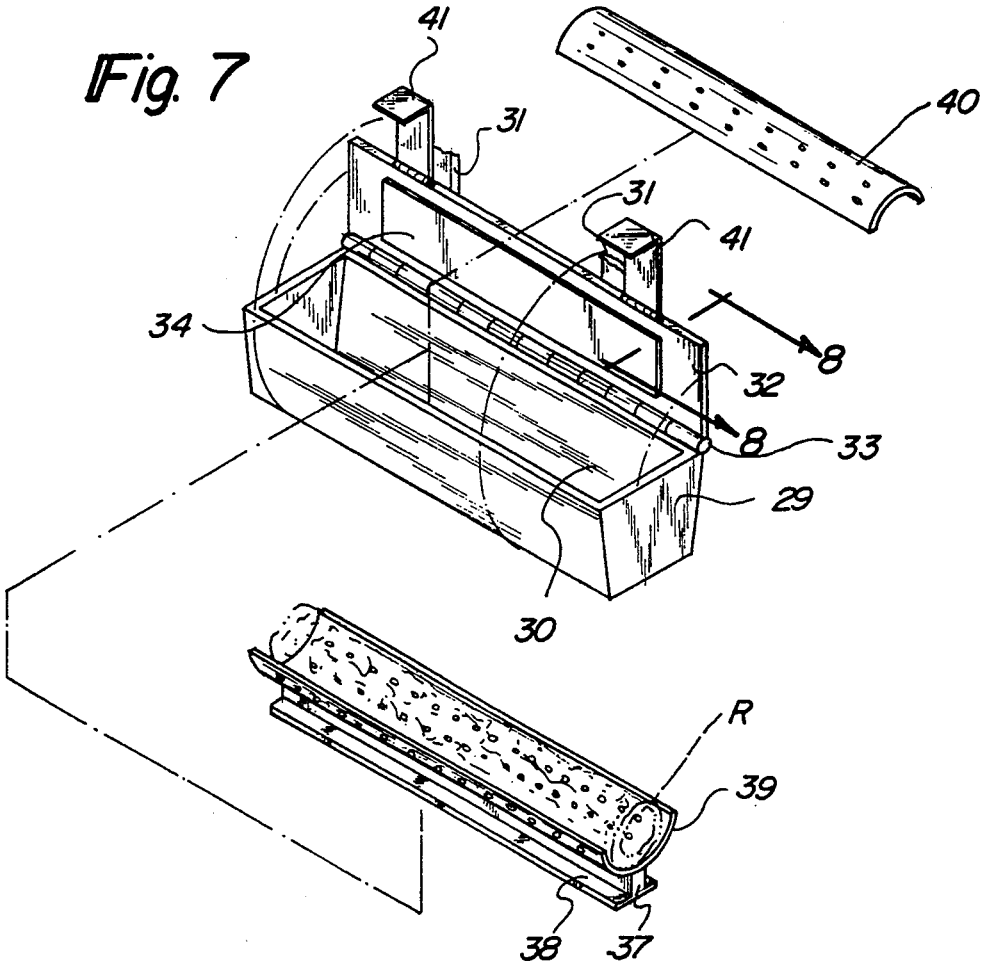
FIG. 7 is an isometric illustration of a modified trough structure for employment by the invention.
Figure 8:
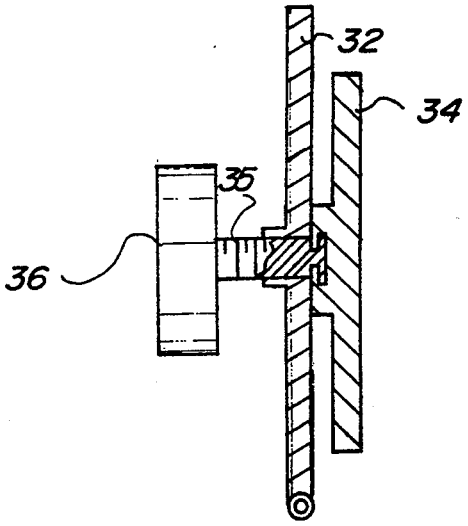
FIG. 8 is an orthographic view, taken along the lines 8—8 of FIG. 7 in the direction indicated by the arrows.

A modified trough structure, as illustrated in the FIGS. 7 and 8, having a press plate 34 mounted to the trough lid 32 that in turn is hingedly secured to the trough about a hinge 33. The press plate 34 includes at least one threaded rod 35 threadedly directed through the lid and rotatably mounted to the press plate at a first end of the rod 35, with a second end of the rod having a rod handle 36 fixedly mounted thereto to permit rotation of the rod threadedly through the lid to project the press plate into the trough 30. Within the trough, a support flange 37 is arranged for positioning upon the trough floor, with the flange having a flange base 38, with the flange base including a semi-cylindrical apertured rigid mounting cradle 39 fixedly mounted to the flange base 38. The apertured mounting cradle 39 is substantially coextensive with the trough 30 for receiving a paint roller "R" thereon. A rigid semi-cylindrical apertured press cradle 40 is arranged for positioning upon the paint roller "R", wherein the mounting cradle 39 is of a first diameter, with the press cradle 40 of a second diameter less than the first diameter receiving the press cradle within the mounting cradle, whereupon rotation of the handle 36 directs the press plate 34 into the trough and projects the press cradle against the mounting cradle to express paint from within the roller and receive the paint between the cradle 39 and the base 38. If required, a plurality of latch flanges 41 are provided and mounted to the lid 32 for securement and sealing of the lid relative to the trough 29.

Figure 9:
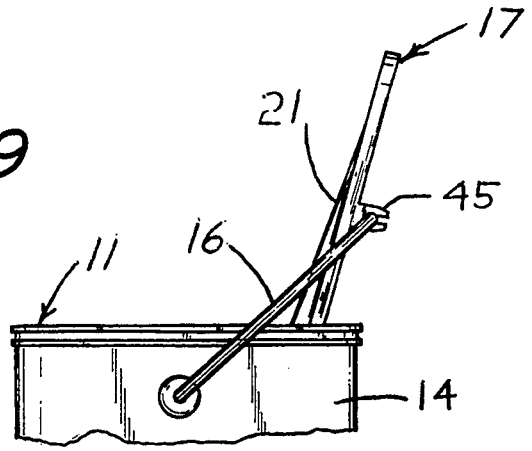
FIG. 9 is an orthographic side view of a modified aspect of the tray structure.
Figure 10:
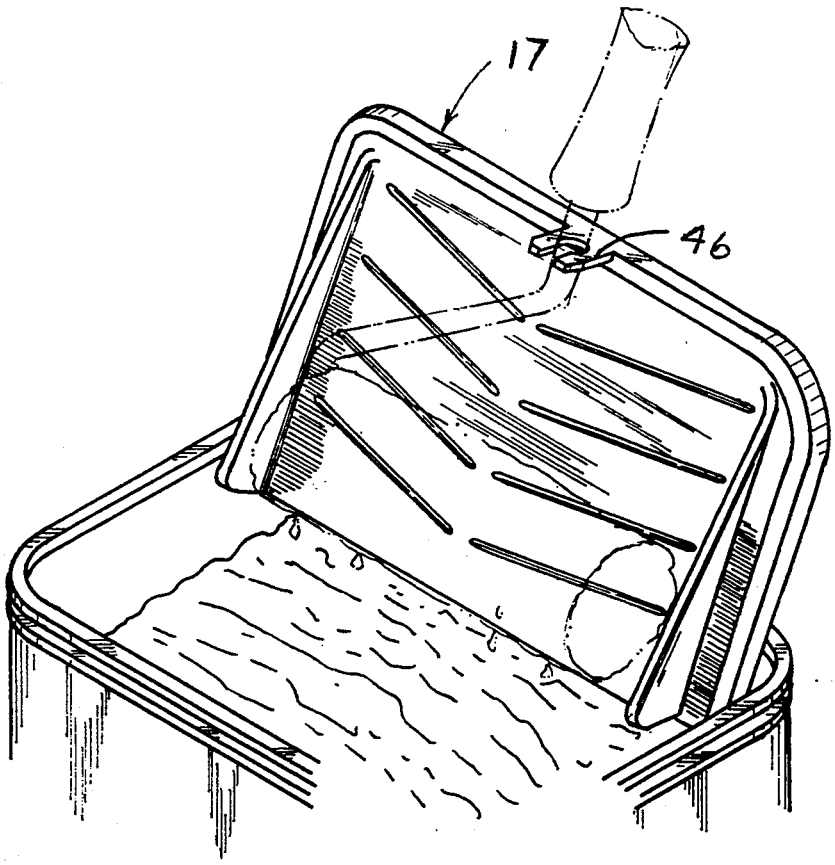
FIG. 10 is an isometric illustration of the tray structure to further include a roller supporting tab member.

FIG. 9 indicates the lid member 17 to further include a U-shaped spring clip 45 mounted to the top wall of the lid member to resiliently receive and engage the handle 16 therewithin to maintain the lid in a desired orientation directed into the container 11, in a manner as illustrated in FIG. 9. FIG. 10 indicates a further modified aspect of the tray structure to further include to the structure of FIG. 9, a second spring clip member 46 arranged to receive and secure the handle portion of the roller member, as indicated in phantom, to provide for positioning of the roller member and its storage in a temporary manner relative to the container and lid structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint roller container and lid including a container, the container having a first side wall spaced from a second side wall, a first end wall spaced from a second end wall, and a handle pivotally mounted to the first end wall and the second end wall, and a lid, the lid including a lid bottom wall, the lid bottom wall including at least one row of parallel ribs, said ribs arranged in a parallel relationship relative to one another, and a first U-shaped bracket mounted within the container to the first end wall, and a second U-shaped bracket mounted within the container to the second end wall, wherein the first and second U-shaped brackets are arranged in a facing mirror image relationship relative to one another, with the first U-shaped bracket including a first slot, the second U-shaped bracket including a second slot, wherein the first slot and the second slot receive the lid therewithin, with the lid arranged in a projecting relationship above the container, the first U-shaped bracket and the second U-shaped bracket each include a bracket axle pivotally mounting the first U-shaped bracket and the second U-shaped bracket to the container, with each bracket axle including a fastener arranged for selective angulation of the first U-shaped bracket and the second U-shaped bracket to the container.

2. A paint roller container and lid as set forth in claim 1 wherein the lid bottom wall includes a first wing plate and a second wing plate orthogonally and fixedly mounted to the lid bottom wall positioning the ribs therebetween to provide for a conduit for paint returning to the container.

3. A paint roller container and lid as set forth in claim 1 including a trough member, the trough member having an elongate trough cavity and a plurality of trough U-shaped mounting legs, wherein the mounting legs are arranged for reception upon the first end wall.

4. A paint roller container and lid as set forth in claim 3 with the trough member having a trough lid, the trough lid includes a press plate, and at least one threaded rod threadedly directed through the trough lid, with the threaded rod having a first end rotatably mounted to the press plate, and a second end having a handle, whereupon rotation of the handle effects projection of the press plate into the trough cavity.

5. A paint roller container and lid as set forth in claim 4 including a support flange, the support flange arranged for reception within the trough cavity, with the flange having a base, and the trough member including a trough floor, with the base arranged for positioning upon the trough floor, and the flange including a rigid semi-cylindrical apertured mounting cradle having a first diameter for receiving a paint roller thereon in a facing relationship to the press plate, and a rigid semi-cylindrical apertured press cradle having a second diameter less than the first diameter arranged for positioning upon a roller positioned upon the mounting cradle to project the press cradle into the mounting cradle upon projection of the press plate into the trough cavity.

6. A paint roller container and lid as set forth in claim 5 including at least one latch flange secured to the trough lid arranged for securing the trough lid to the trough member.

7. A paint roller container and lid as set forth in claim 6 wherein the lid further includes a lid top wall surface, said lid includes a spring clip member mounted to said lid top wall surface to receive the handle relative to the lid.

8. A paint roller container and lid as set forth in claim 7 wherein the lid further includes a second spring clip member mounted to the lid bottom wall to receive and secure a paint roller handle therewithin.

* * * * *